US006837674B2

(12) United States Patent
Phillips, III

(10) Patent No.: US 6,837,674 B2
(45) Date of Patent: Jan. 4, 2005

(54) SAFETY JACKET FOR ROTARY BLADE HOUSINGS

(75) Inventor: Daniel Cunnington Phillips, III, Bel Air, MD (US)

(73) Assignee: Sun Automation Inc., Sparks, MD (US)

( * ) Notice: Subject to any disclaimer, the term of this patent is extended or adjusted under 35 U.S.C. 154(b) by 104 days.

(21) Appl. No.: 10/274,540

(22) Filed: Oct. 21, 2002

(65) Prior Publication Data

US 2004/0076508 A1 Apr. 22, 2004

(51) Int. Cl.[7] ..... F04D 29/40

(52) U.S. Cl. ..... 415/1; 415/9; 415/206

(58) Field of Search ..... 415/1, 9, 203, 415/206

(56) References Cited

U.S. PATENT DOCUMENTS 3,974,313 A * 8/1976 James ..... 428/176
4,057,359 A * 11/1977 Grooman ..... 415/9
4,452,563 A * 6/1984 Belanger et al. ..... 415/9
4,705,454 A * 11/1987 Bouiller et al. ..... 415/197

* cited by examiner

*Primary Examiner*—Ninh H. Nguyen
(74) *Attorney, Agent, or Firm*—William E. Mouzavires

(57) ABSTRACT

A flexible jacket for a vacuum blower having rotatable blades in a blade housing. The jacket is made from heavy duty, substantially impenetrable, bullet resistant material such as KEVLAR brand sheet material which is placed about the blade housing to prevent any severed and flying rotor blades from entering the atmosphere through the blade housing. The configuration of the jacket is formed to match the blade housing and to enable the jacket to be easily retro-fitted onto existing vacuum blowers or other blade housings and secured in place about the blade housing.

18 Claims, 3 Drawing Sheets

SAFETY JACKET FOR ROTARY BLADE HOUSINGS

BACKGROUND OF INVENTION

Today there exists various machinery including high speed rotating blades in a housing, the blades being driven by a motor, engine, liquid or other mediums. Occasionally the blade may rupture and strike the housing and even pierce the housing where it may strike a person in the surrounding area. The risk of such accidents is even greater when the housing is made from aluminum and the blades operate at very high speed. The present invention seeks to minimize if not remove such risk.

OBJECTS OF THE PRESENT INVENTION

The present invention generally relates to safety jackets for machinery and more particularly to a novel safety jacket for rotary blade housings.

An object of the present invention is to provide a novel and improved safety jacket for a rotary blade housing such as for example, included in a vacuum pump or blower.

A further object of the present invention is to provide a novel safety jacket that may be easily applied to or removed from a rotary blade housing and yet will prevent broken or ruptured blades from flying through the associated housing and entering the surrounding environment where they can cause serious injury.

Another object of the present invention is to provide a novel safety jacket for a rotary blade housing that will achieve the above objects and yet may be retro-fitted in situ to existing machinery. Included herein is such a safety jacket that may be manufactured with readily available materials and methods.

A still further object of the present invention is to provide a novel method of preventing broken rotary blades from entering the atmosphere through the housing of machinery such as vacuum blowers.

SUMMARY OF PREFERRED EMBODIMENT OF THE PRESENT INVENTION

In summary, the present invention, in its preferred form, provides a safety jacket that may be retro-fitted about a rotary blade housing of a machine such as for example a vacuum blower. The jacket is made from sheets of heavy duty, bullet resistant, material such as KEVLAR brand material, that is shaped to fit around and cover the blade housing. The jacket is generally form-fitting when placed about the blade housing. In order to place the jacket on the blade housing, the jacket is opened by separating its two free ends and then placed laterally against and about the housing. The jacket is then closed by bringing its ends together with one end overlapping the other end. Fasteners are then inserted through both ends to secure the jacket against removal from the housing. The process is reversed to remove the jacket from the blade housing.

DRAWINGS

Other objects and advantages will become apparent from the following, more detailed description taken in conjunction with the attached drawings in which.

DETAILED DESCRIPTION

Figure 1:
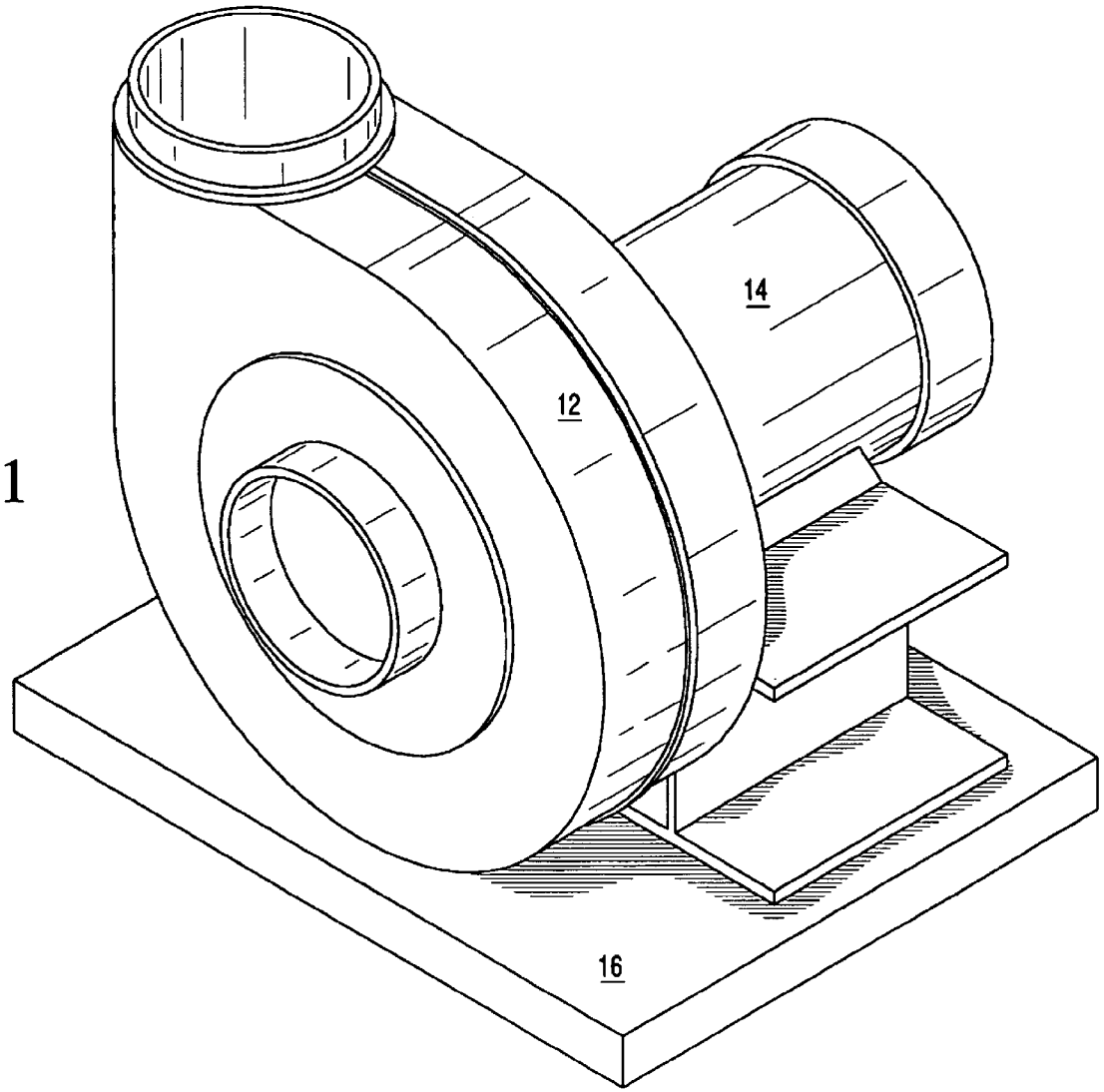
FIG. 1 is a perspective view of a vacuum blower having a blade housing to which the safety jacket of the present invention may be applied.

Referring to the drawings in detail there is shown for illustrative purposes only a safety jacket for a rotary blade housing constituting a preferred embodiment of the present invention. In one use, the jacket is shown as applied to a vacuum blower generally designated 10 shown in FIG. 1 including a generally torroidal blade housing 12 enclosing a rotor including a plurality of blades mounted in the housing 12 for high speed rotation. The housing 12 may be made from cast aluminum for example while the blades may also be made from aluminum for operation at 3,450 rpm for example. Any suitable motor 14 mounted on a base 16 may be used to drive the blades in well known fashion. Housing 12 has in one side thereof an inlet 18 connected to a vacuum chamber of a device (not shown) to draw a vacuum therein, while the air or other gas is expelled from the housing 12 through a port 20 in the top of the housing. Port 20 may be connected to a filter or any other device prior to exhausting into atmosphere or another handling chamber.

Figure 2:
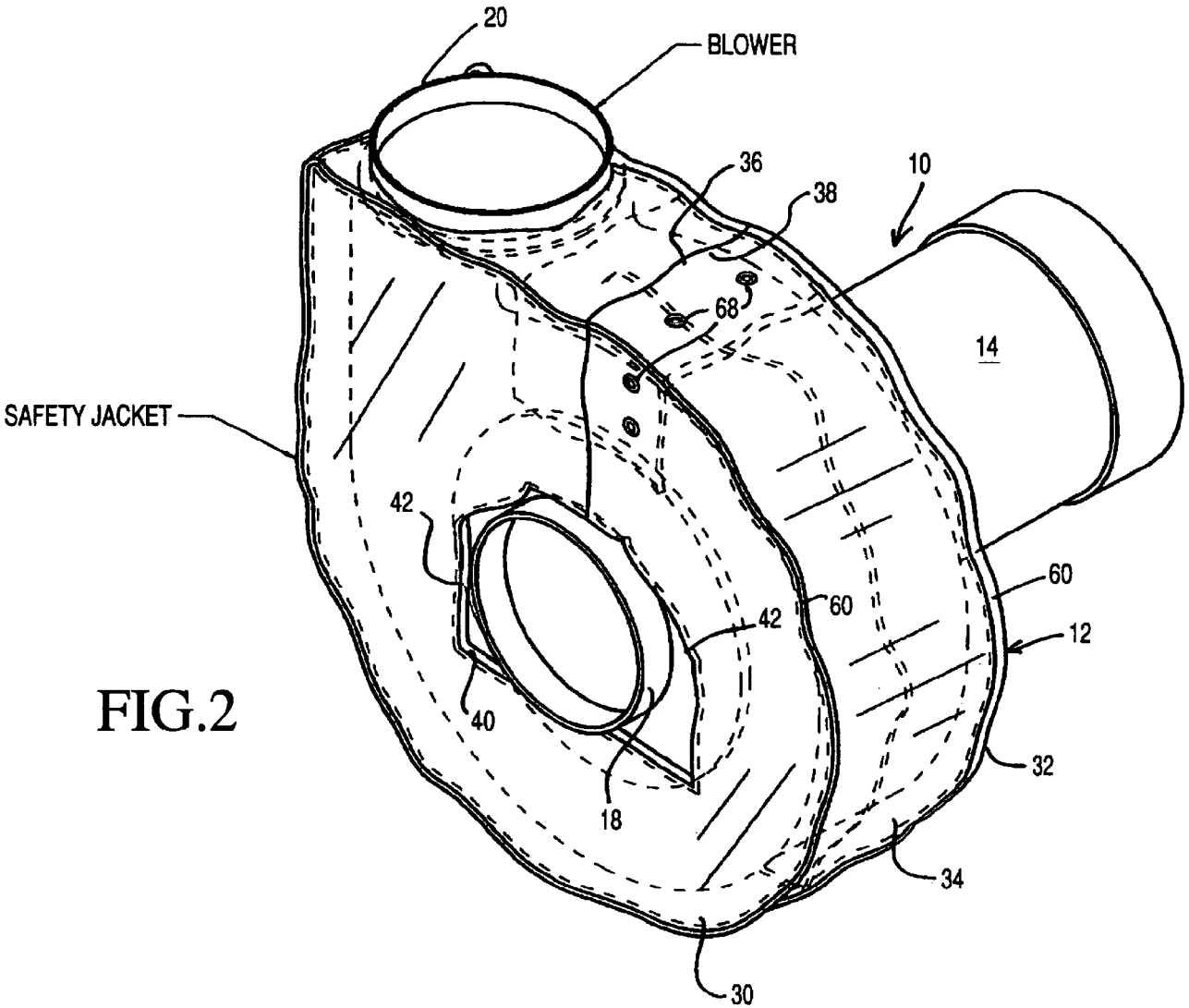
FIG. 2 is a perspective view of a safety jacket of the present invention as applied to the blower of FIG. 1.

Referring to FIG. 2, in the preferred embodiment, jacket 12 includes opposite, laterally spaced, walls 30, 32 separated by and attached to a transverse wall 34 to define a generally torroidal chamber for receiving the generally torroidal-shaped blade housing 12. Walls 30, 32 have ends 36, 38 which when placed against each other as shown in FIG. 2 define aligned openings formed by inner edges of the walls 30, 32. These edges include what will be termed a bottom edge 40, which extends generally straight and horizontally under the inlet port 18 when fitted thereon, and opposite side edges 42, which extend upwardly from the bottom edge 40 and about the inlet port 18. Transverse wall 34 has at its upper end an opening 44 for receiving the outlet port 20 as shown in FIG. 2.

Figure 3:
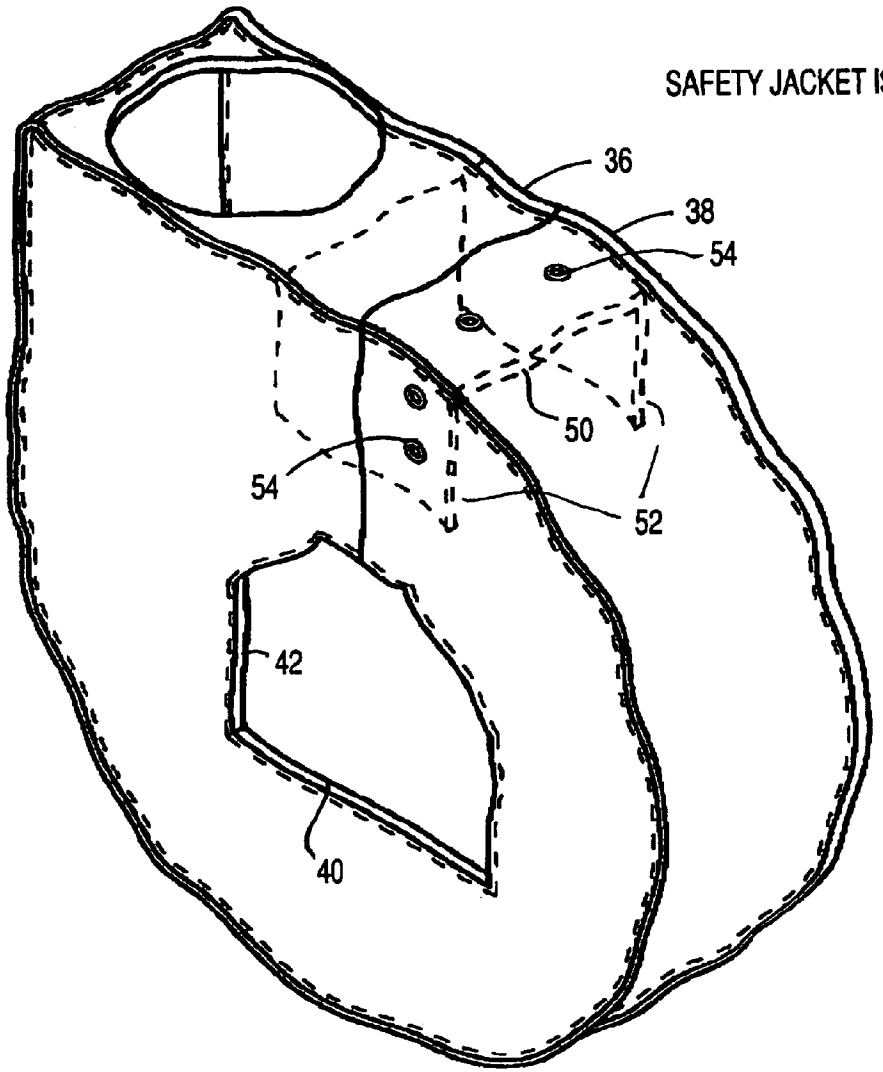
FIG. 3 is a view similar to FIG. 2 but excluding the blower.

Referring to FIG. 3, one end 36 of the jacket has a flap extending therefrom to be received under the other end 38 once fitted on the housing 12 as shown in FIG. 2. The flap includes a top wall 50 and opposite side walls 52 depending from the top wall 50. The top wall 50 and side walls 52 are is placed within the end 38, and secured to the end 38 by fasteners such as bolts extended through grommets or other apertures 54 provided in the walls of the flap apertures 68 and the end 38 to be aligned with each other to receive the fasteners. Once secured, the jacket is not removable from the blower.

The material of the jacket is heavy duty, bullet resistant, impenetrable material preferably KEVLAR material. In the preferred embodiment shown, the opposite side walls 30, 32 of the jacket are sewn to the transverse wall 34 along seams 60. In addition, each of the walls 30, 32 and 34 is made from five (5) layers of flexible KEVLAR sheet material. It will be appreciated that the flexibility of the KEVLAR sheet material facilitates installation of the jacket in situ without having to disassemble the blower itself or remove it from its mounting 16.

To install the jacket on the blower housing 12, the jacket is opened by separating the opposite ends 36 and 38 from each other and then by placing the lower end of the jacket under the housing 12 and then laterally moving the jacket over and under the housing 12 with the central opening in the jacket passing first over the inlet port 18 until the side walls 30, 32 surround the opposite sides of the housing 12.

The flap walls 50, 52 are placed in the end portion 38 of the jacket and the apertures 54 are aligned with apertures 68 in the end 38 of the jacket. Bolts or studs may then be placed through and secured in the apertures 54, 68 by nuts applied to the bolts to secure the jacket on the housing against removal. The jacket may be easily removed by reversing the above process.

It will be seen that once the jacket is applied to the blade housing 12, any detached or broken rotary blades which have penetrated the housing will not be able to enter the surrounding atmosphere due to the jacket which surrounds all portions of the housing. Although a vacuum blower has been shown and described, the present invention is applicable to any other type of rotary blade housing. It should also be understood that although one specific, preferred embodiment of the invention has been shown and described, the scope of the invention is not limited thereto but rather is defined in the appended claims.

What is claimed is:

1. In combination with a rotary blade housing having a plurality of ports, a safety jacket mounted on and covering the housing and including openings aligned with the ports, said jacket being made from material which is resistant to broken or severed rotor blades within the housing to prevent the blades from entering the surrounding environment should they become detached, and wherein said jacket includes opposite side walls and a transverse wall extending between and interconnecting the side walls, said wall being made from flexible sheet material.

2. The combination defined in claim 1 wherein said jacket has opposite ends abutting each other and fasteners securing the ends against separation.

3. The combination defined in claim 1 wherein one of said ends is received within the other end of the jacket.

4. The combination defined in claim 3 wherein said one end has a generally U shaped flap received in the other end of the jacket.

5. The combination defined in claim 1 wherein said jacket generally conforms to the external configuration of the blade housing.

6. The combination defined in claim 5 wherein said jacket has a generally torroidal configuration.

7. The combination defined in claim 1 wherein said walls are made from KEVLAR material.

8. A safety jacket for a rotary blade housing comprising in combination; a body formed of flexible material shaped to define a chamber for receiving and covering a rotary blade housing to resist blades that may become detached and fly through the housing, said body being formed from high strength material which will not be penetrated by high speed rotating blades should they become detached, and wherein said body includes opposite walls interconnected by a transverse wall to define a chamber for receiving an associated blade housing, said walls being formed of flexible sheet material.

9. The safety jacket defined in claim 8 wherein said body is dimensioned and shaped to closely fit and conform to the configuration of a blade housing.

10. The safety jacket defined in claim 8 wherein said body is made from KEVLAR material.

11. The safety jacket defined in claim 8 wherein said transverse wall has an opening for accommodating a first port in an associated blade housing, and one of said walls has an opening for accommodating a second port in the associated housing.

12. The safety jacket defined in claim 8 wherein said body has opposed free ends adapted to be placed into engagement with each other when the body receives an associated blade housing.

13. The safety jacket defined in claim 12 including means for securing said ends to each other for preventing removal of the jacket from an associated blade housing.

14. The jacket defined in claim 12 wherein one of said ends is receivable in the other end when the jacket receives an associated blade housing.

15. The jacket defined in claim 14 wherein said ends have alignable apertures for receiving fasteners for securing the ends together to prevent removal of the jacket from an associated blade housing.

16. A method of enclosing a rotary blade housing to prevent flying detached blades from entering the surrounding atmosphere through the housing, the method including the steps of, applying in situ a receptacle made from flexible material on and around the housing to enclose the housing, and securing adjacent portions of the receptacle together to prevent removal of the receptacle from the blade housing, and wherein the receptacle is applied to the blade housing by moving a central opening in the receptacle about the housing and placing opposite walls of the receptacle to cover opposite walls of the housing respectively.

17. The method defined in claim 16 further including the steps of engaging opposite free end portions of the receptacle together once the receptacle is placed on the housing, and securing the free ends together to prevent removal of the jacket from the housing.

18. A safety jacket for a rotary blade housing comprising in combination, a body defining a chamber for receiving and covering a rotary blade housing to resist blades that may become detached and fly through the housing, said body being formed of material which will not be penetrated by high speed rotating blades should they become detached, said body including opposite walls and a transverse wall interconnecting said opposite walls to define said chamber, said transverse wall having an opening for accommodating a port in an associated blade housing, and one of said opposite walls having an opening for accommodating a second port in the associated blade housing.

* * * * *